United States Patent [19]

Norris

[11] 4,181,246

[45] Jan. 1, 1980

[54] CLOSURE FOR A COLLAPSIBLE TUBE

[76] Inventor: Gilbert H. Norris, R.F.D. #1, Cameron Rd., Mascot, Tenn. 37806

[21] Appl. No.: 889,955

[22] Filed: Mar. 24, 1978

[51] Int. Cl.[2] ..... B65D 47/06

[52] U.S. Cl. ..... 222/548; 215/313; 220/253; 222/553; 222/556

[58] Field of Search ..... 222/548, 553, 556, 516; 215/313, 311; 220/253, 213; 251/352

[56] References Cited

U.S. PATENT DOCUMENTS

| | | | |
|---|---|---|---|
| 1,996,493 | 4/1935 | Schumacher | 222/553 X |
| 2,022,109 | 11/1935 | Earp | 222/548 |
| 2,138,992 | 12/1938 | Baker | 222/548 X |

FOREIGN PATENT DOCUMENTS

| | | | |
|---|---|---|---|
| 567092 | 9/1957 | Italy | 222/553 |

*Primary Examiner*—John P. Shannon

*Attorney, Agent, or Firm*—Pitts and Kesterson

[57] ABSTRACT

A closure for a collapsible tube having a base portion mounted on the reinforced dispensing end of the tube. The base portion of the closure defines a bore communicating at one of its ends with the interior of the tube. The opposite end of the bore opens on the surface of a substantially spherical portion of the base member and serves as an outlet through which the tube contents are dispensed. This outlet is selectively opened and closed by a cap member fabricated from a semi-rigid material which defines a cavity which rotatably receives the spherical member therein. The tube contents are dispensed by rotating a port defined in the cap member into alignment with the base portion outlet and collapsing a portion of the tube wall. In one embodiment means are provided to assist in guiding the rotation of the cap member with respect to the spherical member for purposes of aligning the base portion opening and the cap member opening.

6 Claims, 19 Drawing Figures

CLOSURE FOR A COLLAPSIBLE TUBE

This invention relates to a tube closure and more particularly to a closure for a collapsible tube.

Collapsible tubes are used for dispensing a wide variety of malleable materials, particularly materials having a paste-like consistency. In this connection, the material to be dispensed is disposed in a tube permanently closed at one of its ends. The opposite end or dispensing end of the tube in conventional constructions is provided with a conical shaped reinforcement member which is substantially rigid and serves to maintain the tube walls adjacent the dispensing end of the tube at a spaced location to enhance movement of the material from the tube upon collapsing a portion of the tube wall. To this end, a discharge port which may be defined by a neck portion having a bore therethrough and secured to the reinforcement member at one of its ends may be provided. The neck portion is mounted on the reinforcement member such that the neck bore and an opening provided in the reinforcement member are in fluid communication.

Various types of closures are known for selectively closing the discharge port of the tube. One conventional closure comprises an internally threaded cap which is adapted for being received by an externally threaded neck portion having a bore which communicates with the interior of the tube. Moreover, it is known to provide a spherical type socket mounted on the tube outlet. A cooperating spherical member is inserted into the socket and provided with a port extending therethrough which is selectively moveable into register with a port defined in the socket for dispensing the tube contents.

Various of the prior art devices suffer certain disadvantages, however. For example, in closure systems employing a cap or the like for closing the outlet port, the cap may be lost resulting in drying of the contents of the tube, particularly the contents which are disposed in the neck or discharge port of the tube. Moreover, in certain devices employing a spherical valve member, which is rotatably mounted in a socket secured at the discharge end of the tube, a portion of the contents of the tube is trapped in the spherical valve member and rotated upon movement of the valve to its closed position partially or completely out of contact with the remainder of the tube contents. The tube contents trapped in the valve member may be exposed to the ambient atmosphere resulting in its drying out and a consequent clogging of the valve. It will also be recognized that drying of the tube contents also causes waste inasmuch as the material which has dried prior to its being dispensed is generally undesirable for its intended purpose. Certain of the valve members are also expensive to manufacture or difficult to assemble.

It is therefore an object of this invention to provide a closure for a collapsible tube which assists in preventing drying out of the portion of the tube contents trapped in the closure mechanism subsequent to dispensing a predetermined amount of such contents. It is a further object of the invention to provide a closure which is readily adapted for use in connection with conventional collapsible tubes. It is another object of the invention to provide a collapsible tube closure which assists in preventing the accumulation of waste proximate the dispensing end of the tube. A still further object of the invention is to provide a closure which is easy to assemble. Other objects and advantages will become apparent upon reading the following specification and drawings wherein:

In accordance with various features of the invention, a closure for a collapsible tube is provided. The closure includes a base member having a spherical portion mounted at the discharge end of the tube. This spherical portion defines a bore therethrough which receives the contents of the tube urged from an opening in the tube responsive to applying compression forces to the tube wall. One end of the spherical portion bore opens on the surface thereof and is selectively opened and closed by a cap member which defines a cavity for receiving the spherical portion of the base member. More specifically, the cap member is rotatably mounted on the spherical portion of the base member and defines a port which can selectively be rotated into alignment with the spherical member outlet for purposes of dispensing the tube contents. The spherical portion opening is selectively closed to seal the contents of the tube by rotation of the cap member port away from this opening.

Figure 1:
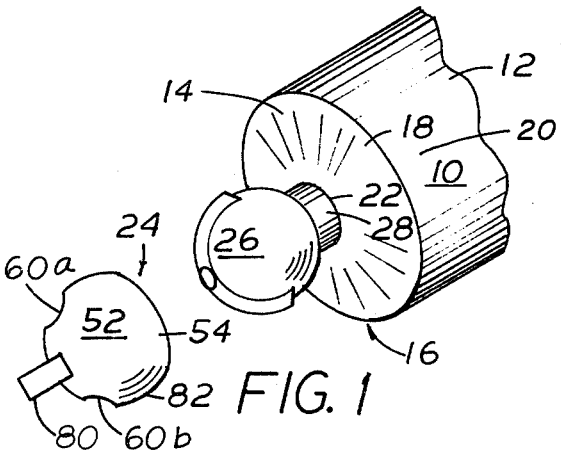
FIG. 1 is a perspective view of a collapsible tube having a closure constructed in accordance with various features of the invention mounted thereon.

Referring now to the drawings, a collapsible tube 10 of conventional design is shown in FIG. 1. The illustrated tube 10 includes a substantially cylindrical wall 12 which is collapsible for purposes of dispensing the malleable contents, such as paste, powder or the like disposed within the tube. In this connection, one end (not shown) of the tube wall 12 is closed. A substantially conical reinforcement member 14 serves to partially close the dispensing or discharge end 16 of the collapsible tube wall 12. More specifically, the reinforcement member is secured along its marginal edge 18 to the end portion 20 of the tube wall 12 and defines an opening 22 through which the contents of the tube are discharged. This reinforcement member 14 assists in maintaining the discharge end of the wall 12 at a spaced location to facilitate discharging the tube contents.

In order to selectively dispense and seal the contents of the tube 10, a closure 24 is provided. The illustrated closure 24 includes a base member 26, which in one embodiment comprises a substantially cylindrical neck portion 28 which is secured at its end 30 to the portion of the reinforcement member 14 proximate the opening 22. This cylindrical neck portion defines an elongated bore 32, which opens at its end 34 on end surface 36 of the neck portion and which is disposed in fluid communication with the opening 22 in the reinforcement member 14 for purposes of receiving the contents of the tube as the tube wall 12 is collapsed by compression forces. The opposite end 38 of bore 32 opens on end surface 40 of the neck portion.

The base member 26 includes a substantially spherical portion 42 which is carried by the neck portion 28 and defines a substantially spherical surface 44. This spherical portion 42 defines a bore 46 which includes a first end 48 that communicates with end 38 of the bore 32 of the neck portion and an opposite end 50 which opens on the surface 44 of the spherical portion 26 at a predetermined location and serves as an outlet through which the contents of the tube are discharged.

Outlet 50 is selectively opened and closed by a cap member 52 which is rotatably mounted on the spherical portion 42 of the base member 26. More specifically, the illustrated cap member 52 includes a wall 54 fabricated from a semi-rigid material such as plastic and defines a cavity 56 proportioned for rotatably receiving a section of the spherical portion 42 therein. In this connection, the cap member wall 54 defines a rim 58 which expands to receive a portion of the spherical surface and snaps into position upon receiving the spherical portion. To assist in preventing the cap member 52 from disengaging the spherical member 42 upon rotation of the cap member 52, rim 58 extends beyond a major diameter 53 of the spherical portion 42 when mounted on the spherical member.

The wall 54 of the cap member 52 defines at least one port 60 which is selectively rotated into and out of register with bore outlet 50 for purposes of dispensing and sealing the contents of the tube, respectively. As shown in the Figures, the cap member wall 4 defines a pair of ports **60*a* and 60*b*, either of which may be moved into register with the outlet 50** for purposes of dispensing the tube contents.

Figure 8:
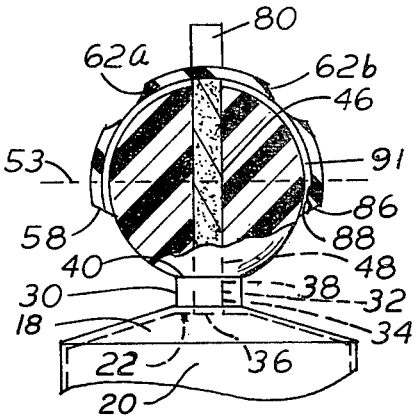
FIG. 8 is a sectional view of the closure shown in FIG. 1 with the cap member mounted on the base member and moved to a closed position.
Figure 2:
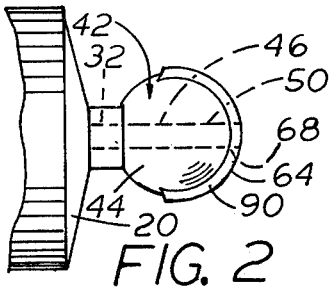
FIG. 2 is an elevation view of the collapsible tube and base member of the closure shown in FIG. 1.
Figure 4:
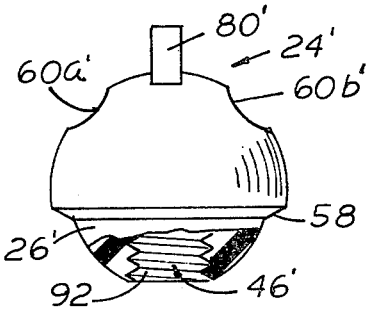
FIG. 4 is an elevation view of the cap member shown in FIG. 1.
Figure 4:
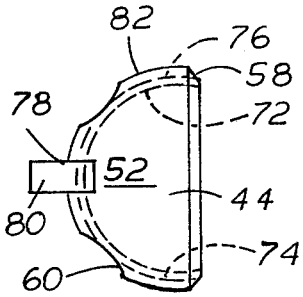
Figure 5:
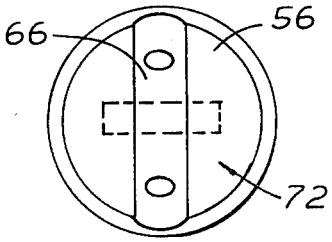
FIG. 5 illustrates the inside of the closure cap member shown in FIGS. 1 and 4.
Figure 6:
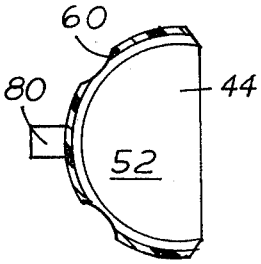
FIG. 6 is a sectional view of the cap member of the closure shown in FIG. 4.
Figure 7:
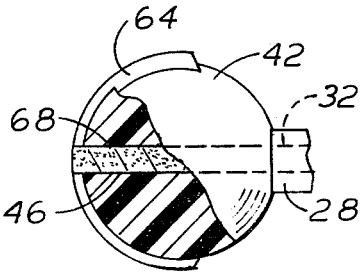
FIG. 7 is a partial sectional view of a portion of the base member of the closure system shown in FIG. 1.
Figure 10:
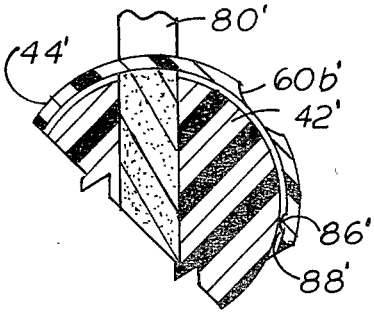
FIG. 10 is a sectional view showing a portion of the closure in FIG. 9.

As shown in FIG. 4, 6 and 8 each of the ports **60*a* and 60*b* in the cap member 52 are flared outwardly from their respective end portions 62*a* and 62*b* which open into the cavity 56. In this connection, the contents of the tube are less likely to lodge within the port and cause clogging subsequent to dispensation. For example, when the closure 24** is used on a paste containing tube, such as a toothpaste tube, the port can readily be wiped clean with a tooth brush subsequent to dispensing a portion of the tube contents.

Figure 3:
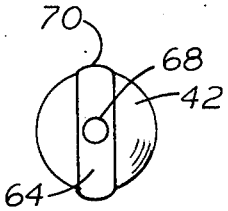
FIG. 3 is an end view of the portion of the closure shown in FIGS. 1 and 2.

Means are provided to assist in guiding the rotation of the cap member 52 such that one of the cap ports 60 can be aligned with end 50 of the bore 46 to dispense the contents of tube 10 upon collapsing the tube wall. In the illustrated embodiment the guide means comprises a cooperating tongue 64 and groove 66. The illustrated tongue 64 is arcuate and integrally formed with the surface 44 of the spherical portion 42. This tongue 64 defines a bore 68 therethrough which communicates at one of its ends with the end 50 of the spherical portion bore 46. The opposite end of the bore 68 which opens on the curved surface 70 (See FIG. 3) of the tongue serves as an outlet from which the contents of the tube exit the base portion. As shown in FIG. 3, the diameter of the bore 68 is less than the width of the tongue 64, for reasons which will become apparent hereinafter.

Surface 72 of the cap member wall 54 is provided with groove 66 which opens into the cavity 56 and is proportioned for slidably receiving the tongue 64 upon mounting the cap member 52 on the spherical portion 42. As illustrated in the Figures, the groove 66 is arcuate and extends substantially along the inner circumference of the cap wall 54 from its opposite ends 74 and 76 which terminate at diametrically opposed location on the rim 58. In this connection the cap member can readily be mounted on the base spherical portion by aligning the ends 74 and 76 of the groove with the tongue 64 and pressing the top portion 78 of the cap member such that the cap rim expands around the spherical portion 42 and receives the spherical portion 42 in the cavity 56.

To facilitate rotation of the cap member 52 a suitable tab 80 is provided. The illustrated tab 80 extends radially outwardly from surface 82 of the cap member 52 and may be gripped or engaged by the finger or fingers of an operator for rotation such that one of the cap ports 60 can be moved into alignment with the bore 68 to the end that the contents of the tube 10 are dispensed upon collapsing a portion of the tube wall. Subsequent to dispensation of a portion of the tube contents the cap member 52 is rotated such that the ports 60 are moved to a position for sealing the port with the tongue, i.e., the port is rotated to a location which is out of alignment with the bore 68 extending through the tongue 64.

Inasmuch as the ports 60 and the bore 68 open into the groove 66 and on the surface 70 of the tongue 64, respectively, the contents of the tube dispensed through the closure are not trapped between the cap member and the spherical portion upon rotations of the cap member to a sealing position. Moreover, the ends 62 of the ports 60 serve to cut away the contents of tube which may be trapped in the ports 60 which are flared or tapered outwardly and can readily be wiped clean.

In order to secure the cap member 52 in a closed position for sealing the contents of the tube subsequent to discharging a portion of the tube contents, a suitable locking means is provided. The illustrated locking means comprises a detent 86 defined by the cap wall 54 which projects into the groove 66. This detent 86 is proportioned for being received in recess 88 provided on the tongue 64 proximate the tongue end portion 90. Upon movement of the detent 86 into register with the recess 88, the detent snaps into the recess and secures the cap member in a position for closing the outlet bore 68 and sealing the contents of the tube from exposure to air.

Figure 9:
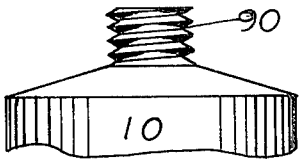
FIG. 9 is an exploded partial sectional view of an alternate closure adapted for being secured on the neck of a conventional collapsible tube.

In certain applications it is desirable to mount the closure of the type shown in FIG. 1 on a conventional collapsible tube having an externally threaded neck 90 (See FIG. 9). In this connection, closure 24' is provided with a base member 26' which includes a bore 46' having an end portion 92 which is of increased diameter and internally threaded. The end portion 92 of the bore 46' is adapted for threadably receiving the neck 90 of the tube 10' with the bore (not shown) extending through the neck 90 being disposed in fluid communication with the spherical member bore 46'.

Figure 11:
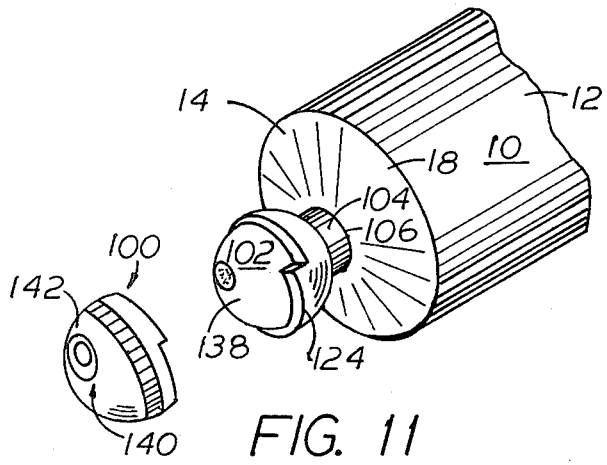
FIG. 11 is a perspective view of an alternate embodiment of the closure showing various features of the invention.

An alternate closure system 100 is illustrated in FIG. 11 and includes a base member 102 which comprises a substantially cylindrical neck portion 104 which is secured at its end 106 to the portion of the reinforcement member 14 proximate the opening 22. This cylindrical neck portion defines an elongated bore 108 which opens at its end 110 on the end surface 112 of the neck portion and which is disposed in fluid communication with the opening 22 in the reinforcement member 14 for purposes of receiving the contents of the tube as the tube wall 12 is collapsed. The opposite end of the bore opens on end surface 116 of the neck portion.

End 118 of the neck portion 104 is integrally formed with a spherical portion 120 which defines a bore 122 therethrough. This spherical portion 120 includes a first section 124 which has a substantially circular outline that is integrally formed with the neck portion 104 of the base member 102. Section 124 of the spherical portion 120 is integrally formed with a further section 126 having a substantially circular outline and a reduced diameter. The juncture of section 124 and section 126 of the spherical portion 120 of the base member define an arcuate track 128 having stops 130 and 132 at the opposite ends thereof.

Figure 18:
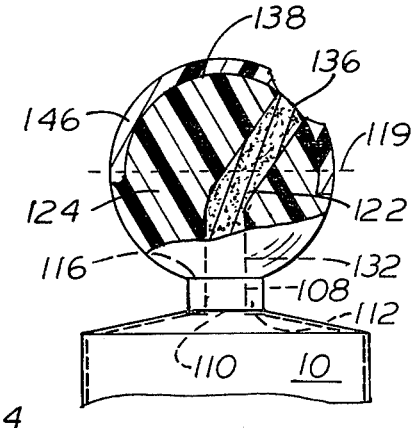
FIG. 18 is a sectional view of the closure shown in FIG. 11 with the cap member mounted on the base member.
Figure 12:
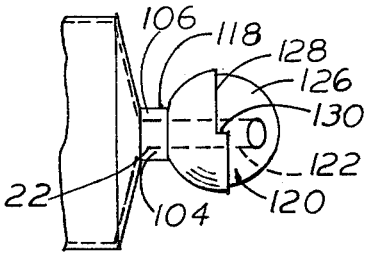
FIG. 12 is an elevation view showing the base member illustrated in FIG. 11.
Figure 13:
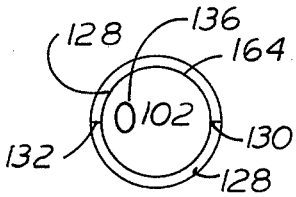
FIG. 13 is an end view of the base member shown in FIG. 11.
Figure 19:
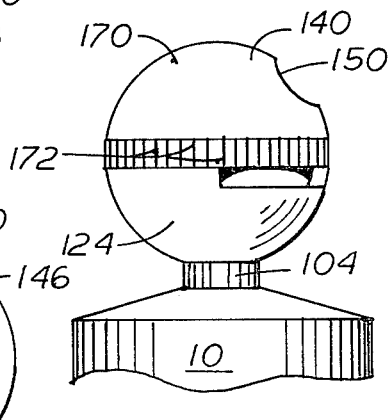
FIG. 19 is an elevation view of the closure shown in FIG. 18.
Figure 14:
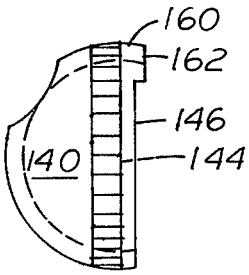
FIG. 14 is an elevation view of the cap member shown in FIG. 11.
Figure 15:
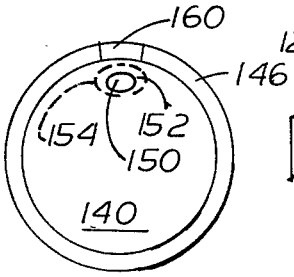
FIG. 15 is a view looking into the cavity defined by the cap member shown in FIG. 14.
Figure 16:
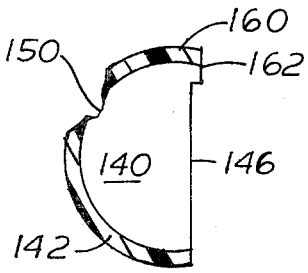
FIG. 16 is a sectional view of the cap member shown in FIGS. 14 and 15.
Figure 17:
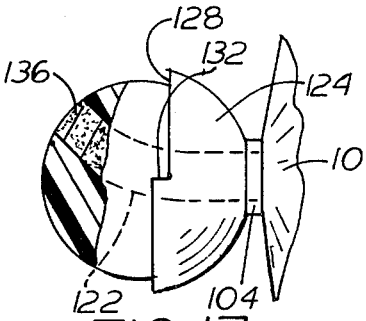
FIG. 17 is an elevation view of the base member shown in FIG. 11 with a portion broken away.

As shown in FIG. 18 the bore 122 defined by the spherical portion 120 has one end 134 which communicates with the end of the bore 108 terminating on surface 116 of the neck portion 104. The opposite end 136 of the bore 122 opens on surface 138 of section 126 and serves as an outlet such that upon collapsing a portion of the wall of the tube 10 the contents of the tube pass through the communicating bores 108 and 122 for purposes of dispensing.

In order to selectively open and close the outlet 136 of the bore 122 a cap member 140 is provided. The illustrated cap member includes a wall 142 fabricated from a semi-rigid material such as hard plastic, which serves to define a hemispherical cavity 144 which is adapted for receiving section 126 of the spherical portion 120 upon mounting the cap member on the base member 102.

In this connection, the cap member wall 142 defines a rim 146 which expands to receive section 126 of the spherical portion 120 and snaps into position when the cavity 144 is filled with the section 126. To assist in preventing the cap member 140 from disengaging the spherical member 120, upon rotation of the cap member, rim 146 extends beyond a major diameter 119 of the member 120 when mounted thereon.

Wall 142 of the cap member 140 defines a port generally illustrated at 150 which may be selectively rotated into alignment with the outlet 136 for purposes of dispensing the contents of the tube. In the illustrated embodiment this port 150 is flared outwardly from its end 152, which opens into the cavity 144, towards the end 154 of increased diameter. In this connection, an edge is defined at end 152 of the port 150 which serves to cut the columnar contents urged from tube upon rotation of the cap member to a sealing position. The portion of the contents trapped in the port 150, if any, can then be readily wiped away through the flared end of the port.

It will be recognized that the cap member 140 is rotated about the longitudinal axis of the tube 10 for purposes of opening and sealing the outlet 136. This rotational movement of the cap member 48 is partially guided by the arcuate projection 160 which extends from the rim 146 of the cap member 140 and is integrally formed therewith. This projection rides in the track 128 defined at the juncture of sections 124 and 126 of the spherical portion and includes an edge 162 which slides across the track surface 164. Rotation of the cap member 140 is terminated upon movement of the projection 160 into contact with either stop 130 or 132.

In order to facilitate gripping the cap member 140 during rotation, the external surface 170 of the wall 142 is provided with a plurality of grooves 172 of predetermined length which serve to assist in preventing slippage of the operator's fingers.

As necessary or desired the base member 120 may be adapted for mounting on a collapsible tube having an externally threaded neck such as shown in FIG. 9. To this end, the base member neck 104 can include a bore 108 which is of increased diameter and internally threaded at its end portion 108 for receiving the neck 90 therein. Alternatively, the neck 104 can be removed and the bore within the spherical member provided with an increased diameter and internally threaded section for receiving the tube neck (See FIG. 9 for example).

From the foregoing detailed description it will be recognized that a closure is provided for selectively dispensing and sealing the contents of a collapsible tube which incorporates certain advantages over the prior art. The illustrated closure includes components which can be readily assembled by hand and are adapted for being mounted on a conventional collapsible tube which may or may not be provided with a neck. Moreover, the cap member serves to selectively seal the contents of the tube and assists in preventing waste which may otherwise be occasioned by trapping the tube contents at a location which may be exposed to air. Further, the closures may be operated by the operator's hand which grips the tube, leaving his other hand free.

It will be understood that although a preferred embodiment of the present invention has been illustrated and described, various modifications thereof will become apparent to those skilled in the art, and accordingly the scope of the present invention is defined by the appended claims and equivalents thereof.

What is claimed is:

1. A closure for a collapsible tube having malleable contents, said tube having a discharge end closed by a reinforcement member defining an opening therethrough, and a further end which is closed, said closure comprising:

a base member including means for mounting said base member to said reinforcement member of said collapsible tube, said means defining a bore therethrough, a substantially spherical portion attached to said mounting means and defining a substantially spherical surface, and an arcuate tongue integrally formed with the surface of said spherical portion, said tongue and said spherical portion defining a bore therethrough, said bore having a first end communicating with said bore through said mounting means and a further end opening on the outer surface of said tongue; and a cap member including a wall defining a substantially hemispherical cavity for receiving a section of said spherical portion of said base member therein, said wall of said cap member defining a groove on the side facing the cavity, said wall further defining at least one port therethrough which opens at one end thereof into said groove, the opposite end of said port opening on the outside surface of said cap member, said cap member being rotatably received on said spherical portion of said base member and guided by said tongue and said groove such that said port in said cap member can be moved into register with the end of said bore opening on said tongue surface for purposes of dispensing the contents of the tube upon collapsing a portion of the tube wall, said cap being rotatable about said spherical portion such that when the cap port and the end of the bore opening on said spherical member surfaces are rotated out of alignment the contents of the tube and portion of the tube contents disposed in the spherical portion of the base member are sealed.

2. The closure of claim 1 wherein said cap member includes a tab extending outwardly from the wall thereof to facilitate rotation of said cap member about said spherical portion of said base member.

3. The closure of claim 1 wherein said port in said cap member is flared outwardly from the end of said port opening into said groove.

4. The closure of claim 1 wherein said reinforcement member of said collapsible tube has an externally threaded neck defining a bore therethrough, said neck having a first and further end, said first end of said neck being secured to the remainder of said reinforcement member such that said bore in said neck communicates with the opening in the remainder of said reinforcement member, and wherein said mounting means includes internal threads in said bore of said spherical portion, said internal threads being proportioned for receiving a section of said externally threaded neck for securing said closure thereon.

5. A closure for a collapsible tube having malleable contents, said tube having a discharge end closed by a reinforcement member defining an opening therethrough, and a further end which is closed, said closure comprising:

a base member including means for mounting said base member to said reinforcement member of said collapsible tube, said mounting means defining a bore therethrough, a substantially spherical portion attached to said mounting means and defining a substantially spherical surface, said spherical portion of said base member including a first section having a substantially circular outline and a further section integrally formed with said first section and having a substantially circular outline of reduced diameter, the juncture between said first section and said further section defining an arcuate track having stops at the opposite ends thereof and said spherical portion defining a bore having a first end communicating with said bore through said mounting means and a further end opening on said surface of said further section having a reduced diameter; and a cap member including a wall defining a substantially hemispherical cavity for receiving said further section of said base member therein, said wall defining at least one port therethrough and a projection, said cap member being rotatably received on said spherical portion of said base member such that said projection slides along said track upon rotation of said cap member such that a port in said cap member can be moved into register with the end of said bore opening on said spherical member surface for purposes of dispensing the contents of the tube upon collapsing a portion of the tube wall, said cap being rotatable about said spherical portion such that when the cap portion and the end of the bore opening on said spherical member surface are rotated out of alignment, the contents of the tube and portion of the tube contents disposed in the spherical portion of the base member are sealed.

6. The closure of claim 5 wherein said reinforcement member of said collapsible tube has an externally threaded neck defining a bore therethrough, said neck having a first and further end, said first end of said neck being secured to the remainder of said reinforcement member such that said bore in aid neck communicates with the opening in the remainder of said reinforcement member, and wherein said mounting means includes internal threads in said bore of said spherical portion, said internal threads being proportioned for receiving a section of said externally threaded neck for securing said closure thereon.

* * * * *